United States Patent [19]

Mori et al.

[11] 4,197,697

[45] Apr. 15, 1980

[54] ALARM WATCH

[75] Inventors: Shigeo Mori; Fumikazu Murakami; Yoshiaki Hara; Ichiro Horikoshi; Souya Takahashi, all of Tokyo, Japan

[73] Assignee: Kabushiki Kaisha Daini Seikosha, Japan

[21] Appl. No.: 746,718

[22] Filed: Dec. 2, 1976

[30] Foreign Application Priority Data

Dec. 2, 1975 [JP] Japan ..... 50-144201
Dec. 2, 1975 [JP] Japan ..... 50-144205

[51] Int. Cl.[2] ..... G04B 37/08; G04C 21/00

[52] U.S. Cl. ..... 368/315; 368/291; 368/250

[58] Field of Search ..... 58/38 R, 57.5, 90 R, 58/55; 340/384 R, 384 E, 387

[56] References Cited

U.S. PATENT DOCUMENTS

| | | | |
|---|---|---|---|
| 3,577,876 | 5/1971 | Spadini | 58/57.5 |
| 3,760,583 | 9/1973 | Tsuruishi | 58/57.5 |
| 3,777,472 | 12/1973 | Iinuma | 58/57.5 |
| 3,879,726 | 4/1975 | Sweany | 340/384 E |

*Primary Examiner*—Edith S. Jackmon
*Attorney, Agent, or Firm*—Robert E. Burns; Emmanuel J. Lobato; Bruce L. Adams

[57] ABSTRACT

An alarm watch has an electro-acoustic transducer with a sound releasing cavity containing a vibrating plate for releasing an audible alarm sound. The surface of the vibrating plate exposed to the open air is treated with a water-repellant material having the property to shed or repel water so that when water enters into the sound releasing cavity and wets the vibrating plate, the vibrating plate readily throws off the water thereby obtaining rapid recovery of the alarm sounding function.

7 Claims, 4 Drawing Figures

ALARM WATCH

BACKGROUND OF THE INVENTION

This invention relates to an alarm watch which is able to rapidly recover its alarm sounding capability often water enters into the sound releasing cavity of the watch.

An alarm watch has a electro-acoustic transducer. In the alarm watch, sound releasing holes are formed through a portion of the casing at locations opposite the vibrating plate of the transducer or through a cover fitted on the casing so that the vibrating sound of the vibrating plate is efficiently released to the exterior of the watch casing.

During use of an alarm watch, water occasionally enters into the sound releasing cavity containing the vibrating plate and the sound releasing holes, for some reason or other. When water enters into the sound releasing cavity and adheres to the surface of the vibrating plate, the equivalent mass of the vibrating plate itself varies and as a result, the resonance frequency of the vibrating plate, the sound volume and the sound tone color also vary.

On the other hand, the area of the openings for emitting the audible sound becomes smaller when water adheres on the surface of the sound releasing holes and the volume of the sound releasing cavity becomes smaller when water adheres on other surfaces of the sound releasing cavity and under such conditions the sound tone color and the sound volume vary accordingly. In the conventional type alarm watch, if water enters into the sound releasing cavity, it is not apt to escape for quite some time so that much time elapses before the alarm sounding function recovers to its former condition.

SUMMARY OF THE INVENTION

It is therefore an object of the present invention to provide an alarm watch which rapidly removes water and recovers the alarm sounding function, i.e., the function of generating enough sound volume and tone color, when water enters into the sound releasing cavity.

BRIEF DESCRIPTION OF DRAWINGS

These and other objects, features and advantages of the invention will become more apparent upon a reading of the following detailed specification and drawing, in which.

DETAILED DESCRIPTION

Figure 1:
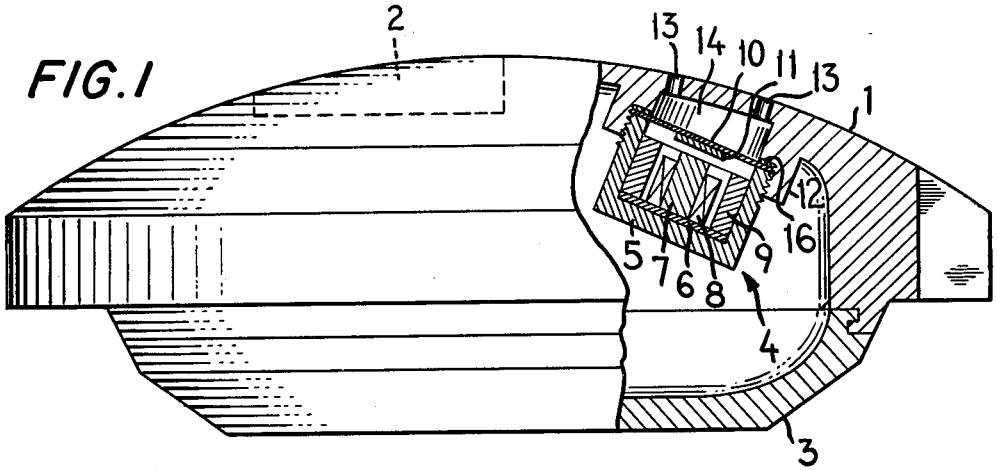
FIG. 1 is a fragmentary sectional view showing an embodiment of an alarm watch according to the invention.

Referring first to the construction of FIG. 1, an alarm watch comprises a casing 1 housing an oscillation circuit which generates a time standard signal, time-keeping circuitry for keeping time according to the time standard signal, a display device which displays time in digital form according to the time signal put out by the time-keeping circuitry, and an alarm circuit which generates an alarm signal when the output from the time-keeping circuitry corresponds to a set predetermined time. These components together with a battery as a power source for driving them are of conventional construction and have been omitted in this figure, as they are not needed in order to understand this invention.

A window part 2 is formed on the casing 1 opposite the display device. The time displayed by the display device can be read through the window part 2. To the lower part of the casing 1, a back cover 3 is removaly attached. An electro-acoustic transducer 4 is provided in the casing 1 facing a part of the upper side wall of the casing 1 having the window part 2. The electro-acoustic transducer 4 is composed of a cylindrical supporting body 5 which is screwed to a circular projection 12 formed on the upper inner wall of the casing 1, a circular plate-shaped lower yoke 6 mounted on the bottom inner surface of the supporting body 5, a magnetic core 7 having an end portion connected mechanically and magnetically to the center of the lower yoke 6, a coil 8 wound on the magnetic core 7, a cylindrical permanent magnet 9, encircling the coil 8 in the supporting body 5 and having an end portion connected mechanically and magnetically to the lower yoke 6, a vibrating plate 10 disposed opposite the magnetic core 7 and permanent magnet 9 at a spaced interval therefrom and being connected around its peripheral edge to the supporting body 5, and an upper yoke 11 mounted on the vibrating plate 10. The electro-acoustic transducer 4 generates an audible alarm sound in response to vibration of the vibrating plate 10, caused by excitation of the coil 8 by the output of the alarm circuit (not shown).

Figure 2:
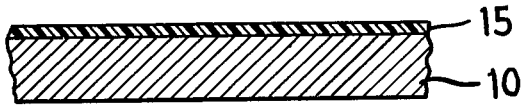
FIG. 2 is a fragmentary expanded sectional view showing a vibrating plate.

Several sound releasing holes 13 are formed through part of the casing at locations opposite to the vibrating plate 10. The space between the upper side wall of the casing 1 having the sound releasing holes 13 and the vibrating plate 10 forms a sound releasing cavity 14. On the exposed surface of the vibrating plate 10 which is exposed to the ambient air through the sound releasing holes 13, as shown in FIG. 2 which is an expanded partly sectional view, a layer 15 having the property to shed water, e.g., Teflon or silicone, is provided by means of painting, enameling or the like, i.e., the exposed surface of the vibrating plate 10 is treated to be water-repellant so as to shed water. By such a construction, if water enters into the sound releasing cavity 14 through the sound releasing holes 13 for some reason or other, drops of water adhering to the vibrating plate 10 are readily thrown off owing to the water-repellant or water-shedding property of the vibrating plate exposed surface. If water occasionally adheres to the vibrating plate 10, it is thus readily removed thereby achieving instant recovery of the alarm function. Numeral 16 in FIG. 1 is a packing for preventing water from entering into the casing 1.

Figure 3:
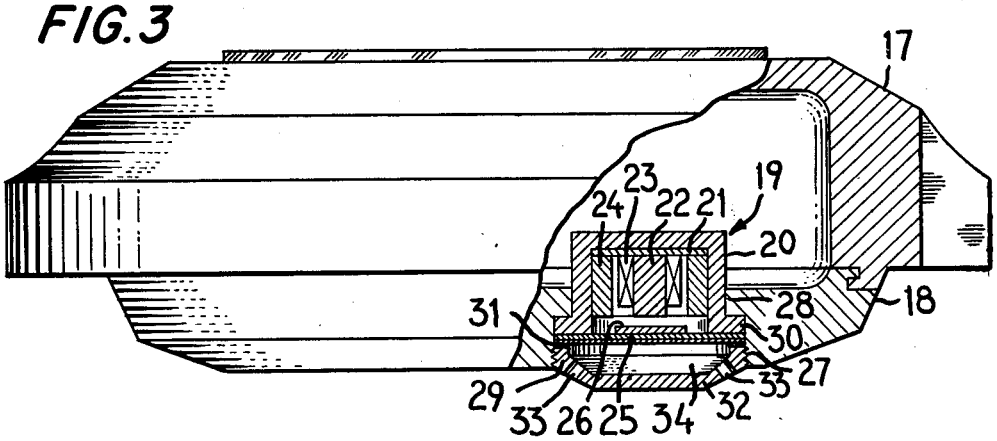
FIG. 3 is a fragmentary sectional view showing another embodiment of an alarm watch according to the invention.

FIG. 3 shows another embodiment of the alarm watch according to this invention which has an electro-acoustic transducer on the back cover of the casing. In the figure, numeral 17 is a casing, 18 is a back cover and 19 is an electro-acoustic transducer. The electro-acoustic transducer 19 is composed of a supporting body 20, a lower yoke 21, a magnetic core 22, a coil 23, a permanent magnet 24, a vibrating plate 25 and an upper yoke 26, all arranged in a manner similar to the electro-acoustic transducer 4 in FIG. 1. The back cover 18 has an opening 27 therein in which is housed to the supporting body 20. The opening 27 has a stepped portion 28 and a flange 30 formed at the end of the supporting body 20 is in contact with the stepped portion 28. The opening 27 has also a screw portion 29 and a cover 32 is screwed into the portion 29 thereby mounting the supporting body 20 on the back cover 18. In order to prevent water from entering into the casing 17 through the space between the flange 30 and the back cover 18, a packing 31 is placed between the vibrating plate 25 and the cover 32.

Several sound releasing holes 33 are formed at a part of the cover 32 at locations opposite the vibrating plate 25 of the electro-acoustic transducer 19. The space between the cover 32 and the vibrating plate 25 forms a sound releasing cavity 34. The exposed surface of the vibrating plate 25 on the side of the sound releasing cavity 34 is treated to shed or repel water with a treating material having the property to shed water, e.g., Teflon or silicone, in a manner similar to the former embodiment. Consequently, if water enters into the sound releasing cavity 34 through the sound releasing holes 33, so that the vibrating plate 25 occasionally gets wet, the water may be readily thrown off in an instant and it is possible to rapidly recover the alarm function.

Figure 4:
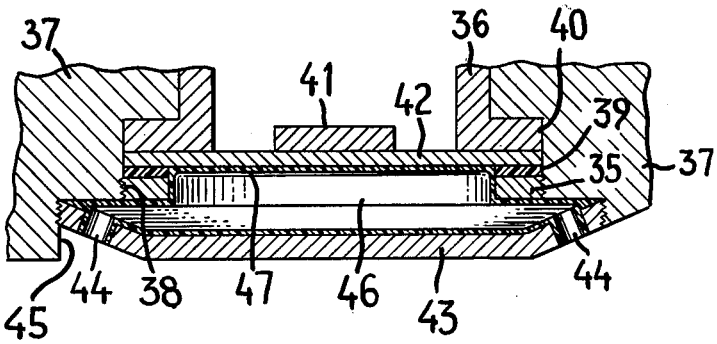
FIG. 4 is a fragmentary expanded sectional view showing another embodiment of a sound releasing cavity according to the invention.

FIG. 4 shows an enlarged detail fo the sound releasing cavity in another embodiment of an alarm watch according to the invention.

In the figure, a holding ring 35 is provided for mounting a supporting body 36 to a back cover 37 in a screw portion 38 of the back cover 37. The holding ring 35 holds an electro-acoustic transducer through a packing 39. The transducer has a supporting body 36 with a flange 40, a lower yoke, a magnetic core, a coil, a permanent magnet, a vibrating plate 42 and an upper yoke 41, similar to that shown in FIG. 3. A cover 43 having plural sound releasing holes 44 is screwed in a recess 45 formed on the back cover 37. The space between the cover 43 and the vibrating plate 42 forms a sound releasing cavity 46.

On the exposed surfaces forming the sound releasing cavity 46, i.e., on the surface of the vibrating plate 42 exposed to the open ambient air through the sound releasing holes 44, of the surface of the holding ring 35, the surfaces of a part of the back cover 37, the surfaces of the cover 43 and the surfaces of the sound releasing holes 44, a layer 47 having the property to shed or repel water, e.g., Teflon or silicone, is provided by means of painting, enameling or the like, i.e., the surfaces forming the sound releasing cavity 46 are treated to shed or repel water.

It is desirable that the treatment to shed water is performed prior to assembling the vibrating plate 42, the holding ring 35, the back cover 37 and the cover 43, for easiness of the treatment. It is possible, however, to perform this treatment after assembly.

Now, if water enters into the sound releasing cavity 46 through the sound releasing holes 44 and adheres to the vibrating plate 42 for some reason or other, the tone and the sound volume of the alarm vary. In this case, as the surface of the sound releasing cavity 46 is treated to shed water with the layer 47, drops of water adhering to the surfaces of the sound releasing cavity 46 are readily thrown off. When the alarm watch has an attitude in which the sound releasing holes 44 face downwardly, the water entering into the sound releasing cavity 46 escapes easily through the sound releasing holes 44. Accordingly, even if water occasionally enters into the sound releasing part 46, so that the volume of the part varies materially or water adheres to the vibrating plate 42, it is possible to recover the alarm function in an instant.

The present invention is not limited to the shown embodiments, and various modifications and improvements may be made. For example, in a case in which the upper yoke on the vibrating plate is provided in the side of the sound releasing cavity, its surface may be also treated to shed water, that is, the part exposed to the open air through the sound releasing holes, in an alarm watch of any type, may be treated to shed water.

What is claimed is:

1. In an alarm watch having a watch case comprised of a case body and a cover member connected to said case body: an electro-acoustic transducer mounted on said watch case and including a vibrating plate having opposite surfaces mounted to undergo vibration to generate an audible alarm sound; means defining a sound releasing cavity in said watch case on one side of said vibrating plate with one of the opposite surfaces of said vibrating plate facing said cavity; means defining sound releasing holes extending through said watch case into said cavity at locations opposite said one surface of said vibrating plate for releasing the audible alarm sound from said cavity to the exterior of said watch case; and means including a layer of water-repellant material on the surfaces of said watch case which define said sound releasing holes and covering said one surface of said vibrating plate for repelling therefrom any water which enters said cavity through said sound releasing holes thereby maintaining the sound quality of the audible alarm sound.

2. An alarm watch according to claim 1; wherein said layer of water-repellant material is selected from the group consisting of Teflon or silicon.

3. An alarm watch according to claim 1; wherein said means for repelling water includes a layer of said water-repellant material on the surfaces of said sound releasing cavity.

4. An alarm watch according to claim 1; including means mounting said electro-acoustic transducer on said case body.

5. An alarm watch according to claim 4; wherein said layer of water-repellant material is selected from the group consisting of Teflon or silicon.

6. An alarm watch according to claim 1; including means mounting said electro-acoustic transducer on said cover member.

7. An alarm watch according to claim 6; wherein said layer of water-repellant material is selected from the group consisting of Teflon or silicon.

* * * * *